United States Patent [19]

Cocks et al.

[11] Patent Number: 4,584,501

[45] Date of Patent: Apr. 22, 1986

[54] FLAT PLATE LUMINOUS DISPLAY DEVICE

[76] Inventors: Franklin H. Cocks, 5 Learned Pl.; Phillip L. Jones, 415 Clarion Dr., both of Durham, N.C. 27705; James P. Schaffer, 3639 Shrewsbury Dr., Durham, N.C. 27707

[21] Appl. No.: 625,109

[22] Filed: Jun. 27, 1984

[51] Int. Cl.[4] ..... H01J 61/33; G09F 13/18

[52] U.S. Cl. ..... 313/493; 313/515; 40/541; 40/542; 40/545; 40/900

[58] Field of Search ..... 313/515, 514, 513, 493, 313/634, 113, 114, 117; 40/541, 542, 543, 544, 545, 900; 372/61

[56] References Cited

U.S. PATENT DOCUMENTS

| | | | |
|---|---|---|---|
| 452,514 | 5/1891 | Beck | 40/545 |
| 1,724,584 | 8/1929 | Hendry | 313/514 |
| 1,825,399 | 9/1931 | Hotchner | 313/515 |
| 1,949,963 | 3/1934 | Hotchner | 313/514 |
| 1,961,735 | 6/1934 | Braun | 313/634 |
| 2,056,383 | 10/1936 | Benway | 40/900 |
| 2,095,291 | 10/1937 | Schneider | 313/25 |
| 2,621,430 | 12/1952 | Neville | 313/634 |
| 2,852,877 | 9/1958 | Goebel et al. | 40/545 |
| 3,085,224 | 4/1963 | Becka | 40/545 |
| 3,388,490 | 6/1968 | Stechemesser | 350/312 |
| 3,731,227 | 5/1973 | Rosenberger et al. | 372/61 |
| 4,395,654 | 7/1983 | Hattori et al. | 313/513 |

FOREIGN PATENT DOCUMENTS

| | | | |
|---|---|---|---|
| 71630 | 8/1915 | Switzerland | 40/542 |

*Primary Examiner*—Palmer C. DeMeo
*Assistant Examiner*—Michael Razavi

[57] ABSTRACT

The invention provides a gas discharge point of purchase display device. This device utilizes two flat vitreous glass plates, one of which contains a continuous channel of any desired shape, and together which form an ionization chamber. These vitreous plates are transparent; however provision is made for the incorporation of an opaque cover layer that conforms to the desired final illuminated geometry and which thus serves to obscure specified channel regions. The simple design of this sign makes possible the construction of these devices in quantity and at a relatively low cost by mass production methods. In the preferred embodiment, the overall effect of the invention is that of a flat plate neon sign, which can contain multiply colored fluorescent materials within a single channel and which can produce letters or characters of varying width and which can appear as an infinite sequence of signs of ever decreasing intensity and size, and which can have multiple gas-discharge paths that are individually selectable by means of a mechanical mechanism placed within the gas-discharge panel.

5 Claims, 4 Drawing Figures

FLAT PLATE LUMINOUS DISPLAY DEVICE

SUMMARY OF THE INVENTION

The invention provides a point of purchase display device comprising two flat vitreous glass plates, one of which contains a continuous channel of any desired shape, and together which form an ionization chamber of controlled shape. These vitreous plates are transparent, however provision is made for the incorporation of an opaque or transluscent cover layer that conforms to the desired final illuminated geometry and which thus serves to obscure specified channel regions. Provision is made for the evacuation of the channel formed when the two plates are sealed together and the subsequent backfilling of the channel with a rare gas such as, but not limited to, neon. Provision is also made for incorporation of electrodes into the two ends of the channel for the purpose of ionizing the gas within the channel. Provision is also made for the incorporation of both front and rear mirrors such that multiple reflections of the luminous display are produced. The simple design of this sign makes possible the construction of these devices in quantity and at a relatively low cost by mass production methods. Provision is made for securing a vacuum-tight seal both between the two glass plates as well as at the two electrodes and at the evacuation tube. In the preferred embodiment, the overall effect of the invention is that of a flat plate neon sign, which can contain multiple fluorescent materials within a single channel and which can produce letters or characters of varying width and which can appear as an infinite sequence of signs of ever decreasing intensity and size, and which can have multiple gas-discharge paths that are individually selectable by means of a mechanical mechanism placed within the gas-discharge path.

OBJECTS OF THE INVENTION

It is an object of the invention to provide a luminous gas-discharge display device capable of being manufactured by inexpensive mass production methods.

A particular object of the invention is to provide a flat plate gas-discharge display device of simple configuration which does not involve the use of isolated tubes or angled engraved slots to form letters or shapes.

A further object of the invention is to provide a gas-discharge display device which utilizes only two glass plates to produce the desired tortuous, tubular, passage channels, and in which only one glass plate possesses channels while the second glass plate functions simply as a top cover for these channels.

Another object of the invention is to produce a luminous gas-discharge display device which offers an infinite series of display images each of which is of continuously decreasing size and intensity.

An additional object of the invention is to provide a luminous gas-discharge display device which is robust and durable.

Still another object of the invention is to provide a gas-discharge display device in which more than one set of letters or other shapes can be caused to be illuminated by means of a mechanical switch that is placed within the glow-discharge itself, so that different display messages can be caused to be illuminated without the need for more than one high voltage power supply and without the need for high voltage switches.

An additional object of the invention is to provide a gas-discharge display device which can be read correctly when viewed either from the front or from the reverse side.

BACKGROUND OF THE INVENTION

Many luminous devices based upon the use of controlled, glowing electrical discharges through inert gasses, especially neon, are known. Most display devices based upon this concept utilize a tortuous path defined by a multiply bent transparent or translucent vitreous tube having electrodes at its terminations. Other methods of producing display devices without using bent vitreous tubes have also been proposed. U.S. Pat. No. 1,949,963 describes the use of multiple flat plates assembled so as to produce a continuous, tortuous, interior channel. The discharge path assembly consists of five flat plates of transparent, insulating material. The two outside plates are solid while the middle inside plate is perforated in such a manner that the engraved channels in the remaining two plates can form a continuous path that crosses back upon itself by means of the perforations. U.S. Pat. No. 1,825,399 features the use of only two glass plates together with the use of either tubular holes cut into one of the plates or engraved passages, which are angled with respect to the glass plate surface, crossing over each other and thereby permitting the formation of a continuous, tortuous pathway which, in its two dimensional projection, crosses over itself.

The use of opaque or translucent letters or symbols applied by painting or by other means has been described in several patents. U.S. Pat. No. 1,724,584 provides for the incorporation of external letters on neon or other gas filled discharge tubes by painting or other means. U.S. Pat. No. 1,805,798 refers to the use of a mirror in combination with an electric sign. A silvered piece of glass in which a portion of the silvered side has been removed is fabricated in such a fashion that the letters or symbols comprising the sign are legible from the glossy side of the silvered glass. Illumination of the letters or symbols is provided by a light bulb placed behind the mirrored glass.

None of these display devices allow the preparation of a luminous gas-discharge display device formed by cutting channels into only a single plate of vitreous insulating material. Furthermore, all of the glow discharge channels that define the desired letters or symbols in these devices are of constant cross-sectional dimension in the defining region. The following drawings illustrate how the objects of the present invention are accomplished.

DETAILED DESCRIPTION

Figure 1:
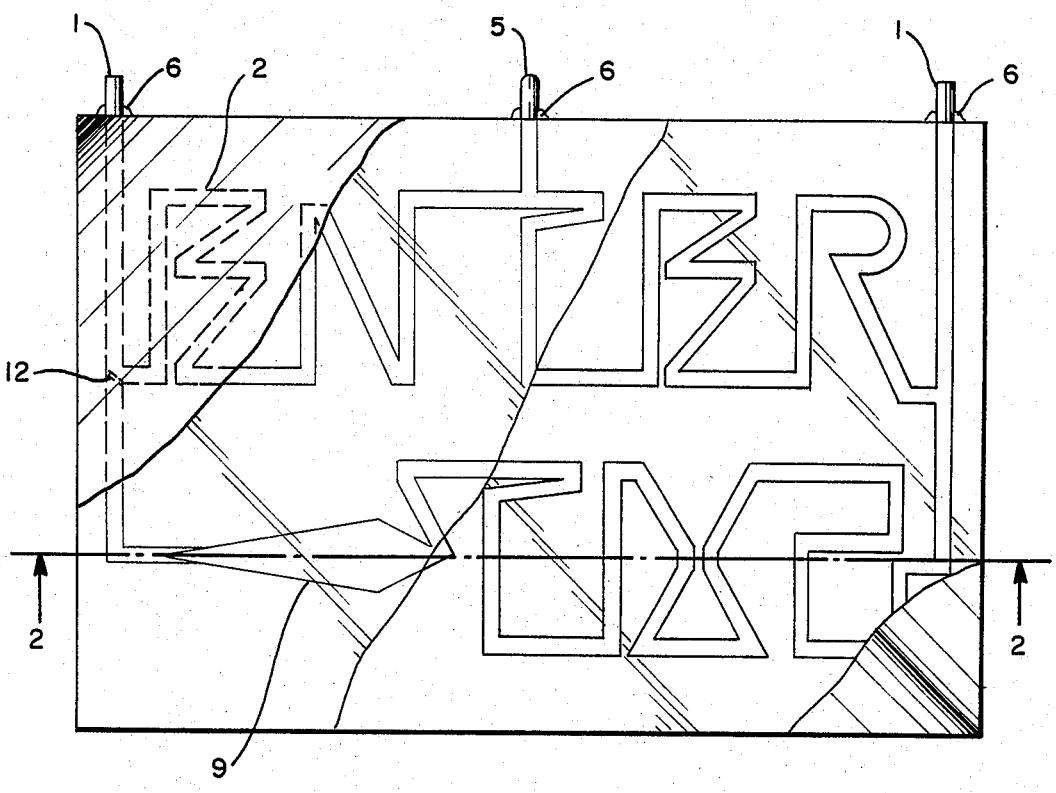
FIG. 1 is a top view of the device showing features of all the preferred embodiments.
Figure 2:
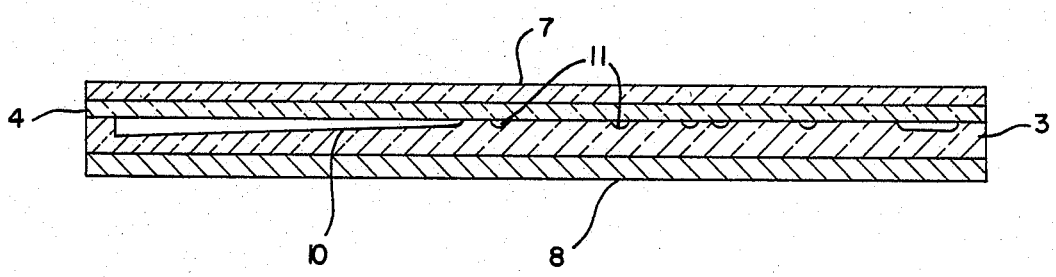
FIG. 2 is a sectional drawing taken upon line 2—2 in FIG. 1.

Referring now to the figures, and in particular to FIG. 1, there is seen a front view of a flat plate luminous display device. Electrical power to said device is supplied through electrodes (1) at the terminations of a continuous channel (2) cut into a glass plate (3) as shown in FIG. 2. The cut channel (2) is covered by a second glass plate (4) as shown in FIG. 2 to form the path for the luminous gas-discharge. The gas-discharge path can be made vacuum tight by heating plates (3) and (4) after they have been placed in contact. Hermetic seals at the electrodes (1) and at the tubulated evacuation access port (5) shown in FIG. 1 can be accomplished by the use of glass frit (6).

FIG. 2 shows the front-surface obscuring plate (7) which is transparent in those selected regions at which it is desired that the luminous gas-discharge path be visible when viewed from the front. The back-surface obscuring plate (8) can similarly be made transparent in selected regions at which it is desired that the luminous gas-discharge path be visible when viewed from the rear. The continuous channel (2) is not limited to an essentially constant cross-sectional geometry. In a particular region (9) the cross-sectional geometry is changed, but the cross-sectional area is maintained essentially constant as shown by the region of changing channel depth (10) in FIG. 2. Fluorescent materials (11) are included in the continuous channel (2) to enable color variations in the luminous gas-discharge display.

Figure 3:
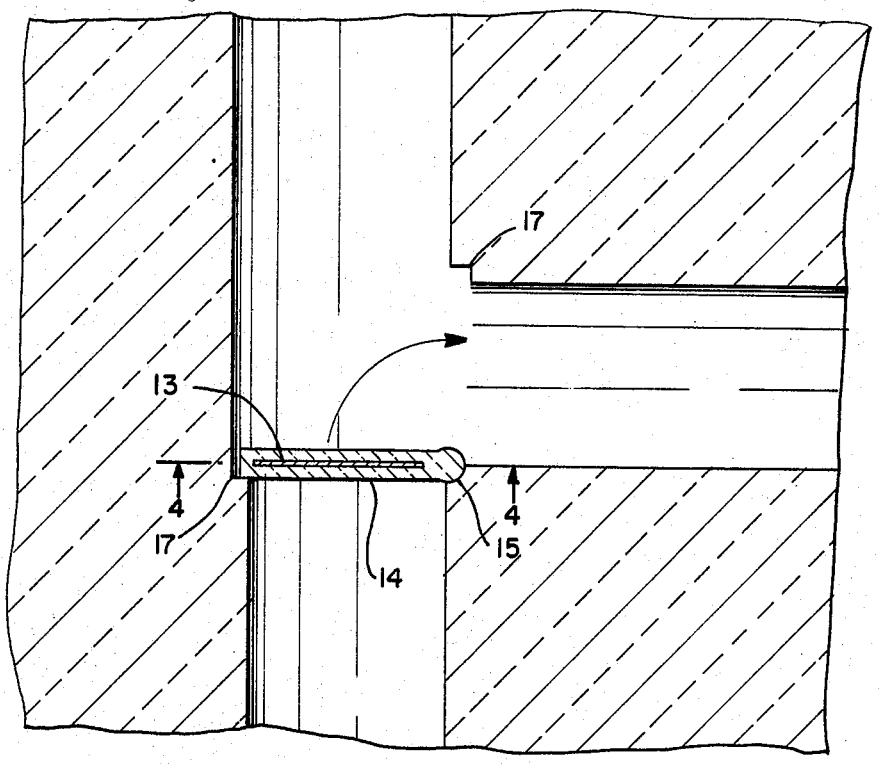
FIG. 3 is an enlarged view of the mechanical plasma switch
Figure 4:
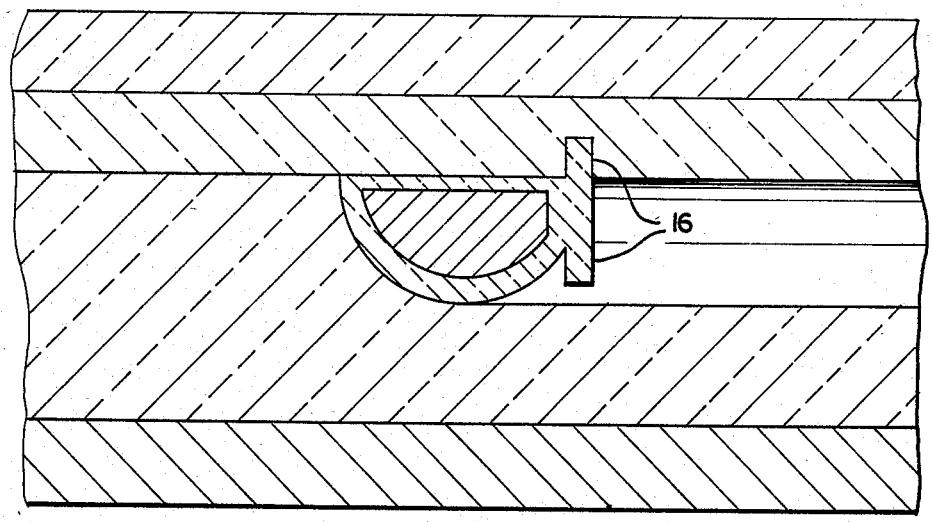
FIG. 4 is a section taken along 4—4 in FIG. 3.

A mechanical plasma switch (12) as shown in FIG. 1 is placed in the continuous channel (2) to direct the luminous gas-discharge through particular regions of the continuous channel (2). The gas-discharge switch (12) contains a ferromagnetic insert material (13) which is sealed within an insulating glass envelope (14), and said glass envelope (14) contains a pivot (15) such that the mechanical plasma switch (12) can be moved as indicated by the arrow in FIG. 3 by means of an externally applied magnetic field. The pivot (15) is held by the top and bottom glass plates which have blind holes (16), sized to receive freely the pivot (15) as shown in FIG. 4. Additionally, as shown in FIG. 4, the shape of the glass envelope (14) conforms to the cross-sectional shape of the continuous channel (2). The range of motion of the mechanical plasma switch (12) is restricted by ledges (17) suitably positioned in said continuous channel (2).

DESCRIPTION OF PREFERRED EMBODIMENTS

A preferred embodiment of this invention comprises a front obscuring sheet (7) shown in FIG. 2, which consists of a mirror whose reflecting surface has been removed to define that part of the glow passage which is to be viewed. A soda glass back plate (3) contains a path which defines the desired gas-discharge path, said path being terminated by electrodes (1) and accessed by a tubulated access port (5) for evacuation and backfilling with neon. Such a front obscuring mirror (7) allows for the appearance of a discontinuous glow path as is required to separate words. In addition, this front mirror (7) defines the logo in the daytime if the glow-discharge is not on, and thus provides an attractive display device at all times.

In an alternative embodiment, this obscuring sheet (7) can be replaced with a semi-transparent mirror. Such a semi-transparent mirror is coated on the back with an opaque material in such a way as to define the logo and allow for the appearance of a discontinuous glow path. When the glow is turned off the device appears as a normal mirror. When the glow is turned on an infinite series of images appears as a result of multiple reflections between the rear mirror and the semitransparent front mirror.

The use of fluorescent materials (11) coating the back of the gas-discharge passage channel allows for a multiply colored display.

Another preferred embodiment of this invention comprises a rear sheet of standard plate glass $\frac{3}{8}$ inches thick (3) into which is cut a continuous channel (2), said channel being produced by sandblasting through an adhesive rubberized mask into which is cut a pattern identical in shape to the desired channel pattern. The front sheet (7) of this preferred embodiment comprises a flat sheet of glass that does not have any channel pattern cut into itself. The channel pattern cut into the bottom plate (3) is neither of uniform width or depth. Instead, this channel is deeper in some places (10) than in others. Similarly, this channel is broader in some places (9) than in others. In particular, in those places where the channel is broader it is also shallower such that the glow discharge is forced to spread into the broader channel. By making the channel shallower where it is broader, the electrical impedance is maintained essentially constant per unit of length. By these means letters and other symbols of the display can be formed to present a uniform glow discharge by varying channel width and depth while maintaining a constant cross sectional channel area. This uniform glow discharge can not be obtained from neon signs or other gas-discharge displays which utilize glass or other vitreous tubes of essentially constant diameter. Before these two plates (3 and 4) are sealed together, fluorescent phosphors (11) of different colors are used to coat the channel (2) cut in the bottom plate (3) so that this device will produce a multicolored display having selected regions which are of different colors, but which still present the textured glow characteristics of gas-discharge display devices which are not coated on their exterior with colored transluscent paints.

Another preferred embodiment of this invention comprises a rear sheet of normal plate glass (3) into which are cut channels and a flat, uncut front sheet of plate glass (4) sealed to said rear sheet (3) by heating. The sealing process is accomplished by placing both sheets (3 and 4) in their desired configuration into a furnace and heating said furnace slowly to 1175 degrees Fahrenheit and holding at this temperature for 24 hours followed by slow cooling back to room temperature. Emplacement of electrodes (1) into the ends of the channels (2) formed by this heating and sealing process is accomplished by the use of Corning Type 7575 glass frit (6) since the electrodes (1) themselves are made using soda glass of the same general type as the glass plates (3 and 4). Following evacuation and filling with neon through a tubulated access port (5) said tubulation is melted and sealed. A front covering (7), composed of a metallized polymeric sheet such that a mirror reflection is produced when the covering is viewed from either the front or the back of said display, is used to cover the resulting gas-discharge device in such a way as to help define the resulting letters by blocking out the glow discharge in selected regions. Additionally, in those selected regions where the gas-discharge is to be obscured the back surface of the front covering (7) is coated with an opaque nonreflecting coating. Finally, an uncut covering (8) is applied to the rear glass plate (3) and this covering is coated with an opaque nonreflecting coating on its front glass-facing surface at points opposite to those coated areas on the front reflective coating. In this way, when operating and viewed from the front, an infinite series of images of the desired logo are seen each image being of reduced intensity so that the infinite series of images appear to fade into the depth of the display device.

Still another preferred embodiment of this invention comprises a luminous gas-discharge display device in which two different but interconnected interior channels (2) are cut. At one of the junctions at which these channels are interconnected a mechanical gate (12) is positioned. This mechanical gate consists of a Kovar metal plate (13) embedded in a glass envelope (14) and fitted with a pivot (15) which fits into blind holes (16) positioned near the midpoint of the junction. By means of a magnet placed on the outside of the rear glass plate (3) this mechanical gate (12) can be rotated so as to switch the luminous portion of the gas-discharge display so that either of two separate gas-discharge paths (2) can be illuminated independently. This switching action is accomplished by means of the increased impedance of the blocked path caused by the insertion of the electrically insulating envelope into the gas-discharge path which is to be extinguished. For example, the two separate but interconnected channels (2) could form the words enter and exit, respectively. The mechanical gate (12) incorporated in the channel (2) as described above can be rotated so as to switch the gas-discharge display so that either the word enter or the word exit is illuminated.

We claim:

1. A gas-discharge display device which comprises a glass plate into which is cut at least one continuous channel, said channel being terminated at both its ends by electrodes for the production of a gas-discharge and provided with a tubulated access port for the purpose of evacuating and backfilling, and a glass top cover which converts the said continuous channel into a continuous tube, said plates being sealed together by heating and said electrodes and tubulated access port being hermetically sealed using a low vapor pressure sealing medium which adheres in a hermetic fashion to both the top and bottom plates, said continuous channel being of constant cross-sectional area but is broadened and made shallow so that the gas-discharge display characters are thereby made of varying width but of constant electrical impedance per unit length.

2. A gas-discharge display device which comprises a glass plate into which is cut at least one continuous channel, said channel being terminated at both its ends by electrodes for the production of a gas-discharge and provided with a tubulated access port for the purpose of evacuating and backfilling, and a glass top plate which converts the said continuous channel into a continuous tube, said plates being sealed together by heating and said electrodes and tubulated access port being hermetically sealed using a low vapor pressure sealing medium which adheres in a hermetic fashion to both the top and bottom plates, said plates additionally being fitted with a front covering to obscure selected parts of the gas-discharge to aid in the definition of the characters, said front covering comprising a semitransparent mirror, which is rendered opaque in selected regions, said plates being additionally fitted with a rear mirror such that an infinite series of images of the gas-discharge display are visible when the gas-discharge display device is viewed from its front surface when the gas-discharge is illuminated, but which has the appearance of a normal mirror when the gas-discharge display device is not illuminated.

3. A gas-discharge display device of the type described in claim 2 in which said rear mirror is tinted so that the infinite series of reflected images are of different hue than that of the gas-discharge itself.

4. A gas-discharge display device of the type described in claim 2 in which said rear mirror is made semitransparent in certain portions and in which said front covering is made as a normal mirror in certain portions such that when viewed from the front an infinite series of one image is produced and when viewed from the rear an infinite series of a second image is produced.

5. A gas-discharge display device which contains at least one interior mechanical gate to control the impedance path to direct the luminous gas-discharge through a particular portion of an interconnected set of gas-discharge channels, said interior mechanical gate comprising a magnetic plate embedded in an electrically insulating envelope fitted with a pivot which fits into blind holes such that the gate can be rotated by means of an external magnet to rest in position against a seating ledge to control the impedance and extinguish the gas-discharge in a portion of said interconnected channel.

* * * * *